United States Patent [19]

Murakami et al.

[11] Patent Number: 4,673,218

[45] Date of Patent: Jun. 16, 1987

[54] TUNNEL EXCAVATION METHOD

[75] Inventors: Susumu Murakami, Sakai; Hiroo Honda, Osaka, both of Japan

[73] Assignee: Okumura Corporation, Osaka, Japan

[21] Appl. No.: 789,017

[22] Filed: Oct. 18, 1985

[51] Int. Cl.[4] ..... E21C 41/00

[52] U.S. Cl. ..... 299/15; 299/19; 405/138

[58] Field of Search ..... 299/15, 10, 19, 13, 299/63; 405/138, 145, 139, 140

[56] References Cited

U.S. PATENT DOCUMENTS

| | | | |
|---|---|---|---|
| 1,093,787 | 4/1914 | Kuhn et al. | 405/138 |
| 3,325,217 | 6/1967 | Enz | 299/15 X |
| 3,597,929 | 8/1971 | Bodine | 405/140 |
| 4,437,795 | 3/1984 | White | 405/259 |

FOREIGN PATENT DOCUMENTS

| | | | |
|---|---|---|---|
| 551137 | 11/1956 | Italy | 405/138 |

*Primary Examiner*—Stephen J. Novosad
*Assistant Examiner*—Michael A. Goodwin
*Attorney, Agent, or Firm*—Birch, Stewart, Kolasch & Birch

[57] ABSTRACT

A method of excavating a tunnel in bedrock, including the steps of boring an outer peripheral slot in the bedrock, boring a plurality of horizontal slots in a bedrock section surrounded by the outer peripheral slot such that the bedrock section is divided into a plurality of bedrock portions by the horizontal slots, boring a plurality of vertical slots in one of the bedrock portions such that the one of the bedrock portions is divided into a plurality of bedrock blocks by the vertical slots, removing the bedrock blocks from the bedrock so as to define a working space, and providing an excavator in the working space such that the remaining ones of the bedrock portions are sequentially excavated by the excavator.

9 Claims, 12 Drawing Figures

TUNNEL EXCAVATION METHOD

BACKGROUND OF THE INVENTION

The present invention generally relates to the excavation of tunnels and more particularly, to a method of excavating a tunnel in hard bedrock without blasting.

A breaker or a boom type tunnel boring machine can be generally employed for excavating a tunnel in bedrock composed of soft rocks or rocks softer than intermediate hard rocks. Meanwhile, these machines cannot be used for excvating a tunnel in bedrock composed of hard rocks and thus, blasting is employed therefor. However, blasting has drawbacks in that vibrations and noises are produced and stones are blown away, thereby aggravating environmental conditions.

Thus, in order to eliminate the above described problems, there has been proposed a method of excavating hard bedrock without blasting as shown in FIGS. 1 and 2. In this known method, a plurality of bore-holes a are drilled on a facing of a tunnel so as to decrease the strength of the bedrock. Then, the bedrock is crushed by a breaker b. In this known method, a central portion of the tunnel can be excavated. However, this known method is disadvantageous in that, since a chisel of the breaker b is likely to slip circumferentially inwardly from the surface of a peripheral wall of the tunnel, it is difficult to finish the peripheral wall of the tunnel accurately. Furthermore, this known method has a disadvantage that since the breaker b is required to be directed upwardly in the case of excavation of an upper end portion of the tunnel, the striking efficiency of the breaker b drops excessively, thus resulting in poor excavation efficiency.

Meanwhile, in another prior art method, a plurality of holes c are bored on a face of a tunnel as shown in FIGS. 3 and 4. Then, an expansion agent including lime is filled into the holes c such that cracks d are produced, between adjacent ones of the holes c, in the bedrock. Thereafter, the bedrock is crushed for excavation by the breaker b. However, this prior art method has an inconvenience in that since a long time period is required for generating a predetermined expansion pressure upon curing of the expansion agent, the waiting time in excavation work increases when a bedrock portion to be excavated is limited in area as in the case of the tunnel.

Furthermore, in these known methods, the bedrock is crushed for excavation, mainly through shear fracture thereof, by the breaker b. It is to be noted that shear strength of hard rocks is approximately twice as large as their tensile strength. Thus, these known methods have such drawbacks including poor working efficiency as compared with that of methods based on tensile fracture.

SUMMARY OF THE INVENTION

Accordingly, an essential object of the present invention is to provide a method of excavating a tunnel in bedrock, in which an outer peripheral slot is initially bored in the bedrock along an outer periphery of a cross section of the tunnel such that a peripheral wall of the tunnel can be finished accurately, with substantial elimination of the disadvantages inherent in conventional methods of this kind.

In order to accomplish this object of the present invention, a method of excavating a tunnel in bedrock embodying the present invention comprises the steps of: boring an outer peripheral slot in the bedrock along an outer periphery of a cross section of the tunnel such that a part of the bedrock is surrounded by the outer peripheral slot; boring in the part of the bedrock a peripheral of horizontal slots spaced vertically a predetermined distance from each other such that the part of the bedrock is divided into a plurality of bedrock portions by the horizontal slots; boring a plurality of vertical slots in one of the bedrock portions such that the one of said bedrock portions is divided into a plurality of bedrock blocks by the vertical slots; removing the bedrock blocks from the bedrock so as to define a working space; and providing an excavator in the working space such that the remaining ones of the bedrock portions are excavated for removal sequentially in an increasing order of distance of the remaining ones of the bedrock portions from the one of the bedrock portions by the excavator.

BRIEF DESCRIPTION OF THE DRAWINGS

This object and features of the present invention will become apparent from the following description taken in conjunction with the preferred embodiment thereof with reference to the accompanying drawings, wherein.

Before the description of the present invention proceeds, it is to be noted that like parts are designated by like reference numerals throughout the accompanying drawings.

DETAILED DESCRIPTION OF THE INVENTION

Figure 1:
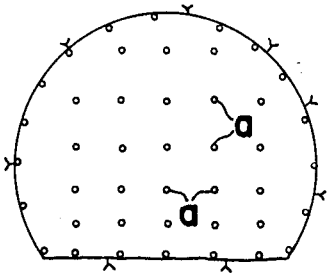
Fig. 1 PRIOR ART
FIGS. 1 and 2 are a front elevational view and a vertical cross sectional view of a tunnel to be excavated by a prior art tunnel excavation method, respectively (already referred to)
Figure 2:
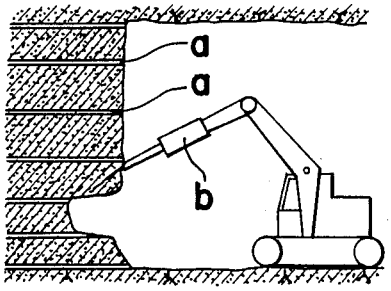
Fig. 2 PRIOR ART
Figure 3:
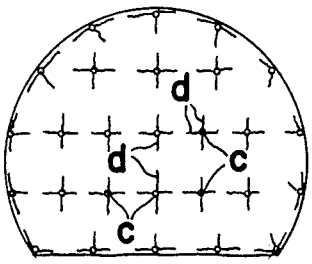
Fig. 3 PRIOR ART
FIGS. 3 and 4 are views similar to FIGS. 1 and 2, respectively, particularly showing another prior art tunnel excavation method (already referred to)
Figure 4:
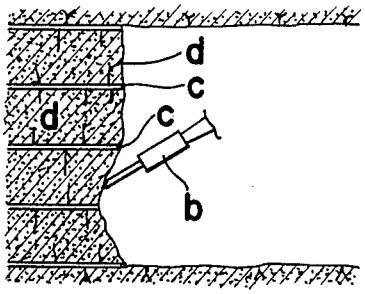
Fig. 4 PRIOR ART
Figure 5:
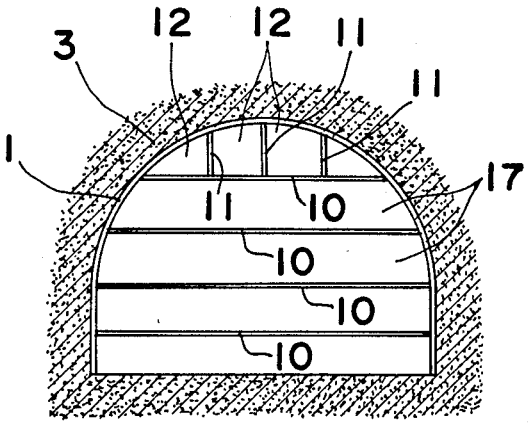
FIGS. 5 and 6 are a front elevational view and a vertical cross sectional view of a tunnel to be excavated by a tunnel excavation method according to the present invention, respectively.
Figure 6:
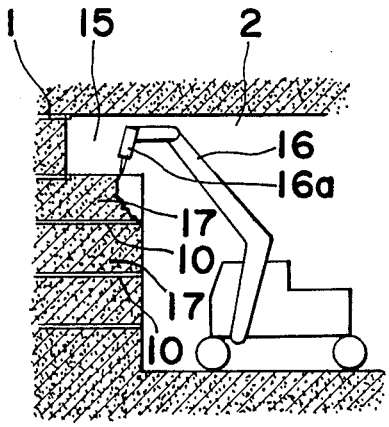

Referring now to the drawings, there is shown in FIGS. 5 and 6, a tunnel 2 to be excavated in bedrock 3 by a tunnel excavation method according to the present invention. In the tunnel excavation method of the present invention, an outer peripheral slot 1 of a substantially U-shape is bored in the bedrock 3 along an outer periphery of a cross section of the tunnel 2 to a desired depth in a direction of excavation of the tunnel 2 by using a slot boring machine 4.

Figure 7:
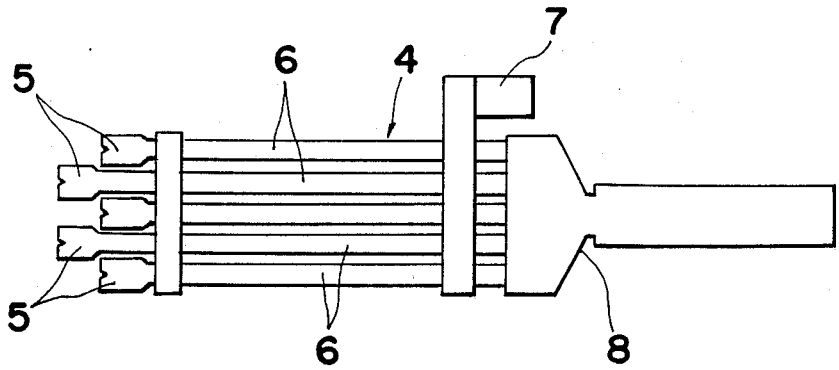
FIG. 7 is a schematic side elevational view of a slot boring machine.
Figure 8:
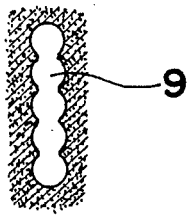
FIG. 8 is a cross-sectional view of a slot bored by the slot boring machine of FIG. 7.

As shown in FIG. 7, the slot boring machine 4 includes a plurality of rods 6 arranged in parallel with each other and each having a bit 5 formed at a front end thereof, a motor 7 and a striking device 8. Adjacent bits 5 are axially deviated from each other and are laterally spaced from each other such that holes bored by adjacent bits 5 overlap each other. The rods 6 are rotatably provided so as to be rotated by the motor 7 through a proper gear train (not shown) and rear ends of the rods 6 are struck by the striking device 8, whereby a slot 9 shown in FIG. 8 is bored by the slot boring machine 4. The outer peripheral slot 1 is obtained by boring a plurality of the slots 9 circumferentially continuously.

Subsequently, by using the slot boring machine 4, a plurality of horizontal slots 10 are sequentially bored, to the desired depth in the direction of excavation of the tunnel 2, in a bedrock section surrounded by the outer peripheral slot 1 so as to divide the bedrock section into a plurality of bedrock portions 17 such that opposite ends of each of the horizontal slots 10 reach the outer peripheral slot 1, with adjacent horizontal slots 10 being vertically spaced a proper distance from each other.

Thereafter, by using the slot boring machine 4, a plurality of vertical slots 11 are bored, to the desired depth in the direction of excavation of the tunnel 2, in an uppermost one of the bedrock portions 17, which is surrounded by an uppermost one of the horizontal slots 10 and an upper portion of the outer peripheral slot 1 such that adjacent vertical slots 11 are horizontally spaced a proper distance from each other.

Thus, after the bedrock section surrounded by the outer peripheral slot 1 corresponding to the outer periphery of the tunnel 2 to be excavated has been divided into a plurality of the bedrock portions 17 by a plurality of the horizontal slots 10 and the uppermost one of the bedrock portions 17 is divided into a plurality of bedrock blocks 12 by a plurality of the vertical slots 11, the bedrock blocks 12 are removed from the bedrock 3.

Figure 11:
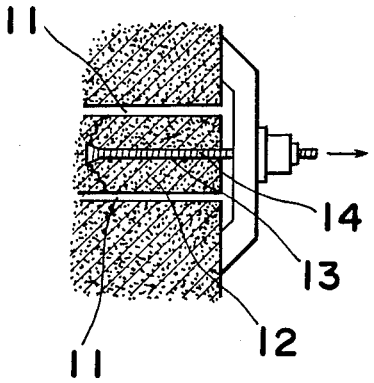
FIG. 11 is a vertical cross sectional view of a bedrock block to be removed by the tunnel excavation method of the present invention.

In order to remove the bedrock blocks 12 from the bedrock 3, such a method as shown in FIG. 11, for example, is employed. In this method, a hole 13 is bored at a central portion of each of the bedrock blocks 12 to a dsired depth. Then, after an anchor bolt 14 has been fitted into the hole 13, a pulling force is imparted to the anchor bolt 14. Thus, a crack is produced at a bottom portion of the hole 13 due to tensile fracture so as to extend from a distal end of the anchor bolt 14 to the corresponding peripheral slots 10, 11 and 12. Subsequently, each of the bedrock blocks 12 is pulled, at the crack, out of the bedrock 3.

After all the bedrock blocks 12 have been removed from the bedrock 3 by the above described method, so as to define a working space 15, a cutting head 16*a* of a breaker 16 is provided in the working space 15 so as to downwardly cut an upper face of an upper one of the bedrock portions 17 towards a lower one of the two neighboring horizonal slots 10 interposing therebetween the upper one of the bedrock portions 17, which upper face is exposed to the working space 15. Thus, the upper one of the bedrock portions 17 is removed from the bedrock 3. This operation is repeated up to a lowermost one of the horizontal slots 10 such that all the bedrock portions 17 are removed from the bedrock 3.

Accordingly, in the tunnel excavation method of the present invention, the outer peripheral slot 1, the horizontal slots 10 and the vertical slots 11 are bored in the bedrock 3 by using the slot boring machine 4 to the proper depth such that the bedrock blocks 12 of the uppermost one of the bedrock portions 17 and the remaining ones of the bedrock portions 17 are removed from the bedrock 3. Thereafter, the outer peripheral slot 1, the horizontal slots 10 and the vertical slots 11 are bored in the bedrock 3 by using the slot boring machine 4 so as to excavate the bedrock blocks 12 and the remaining ones of the bedrock portions 17. By repeating these operations, the tunnel 2 is excavated.

Figure 9:
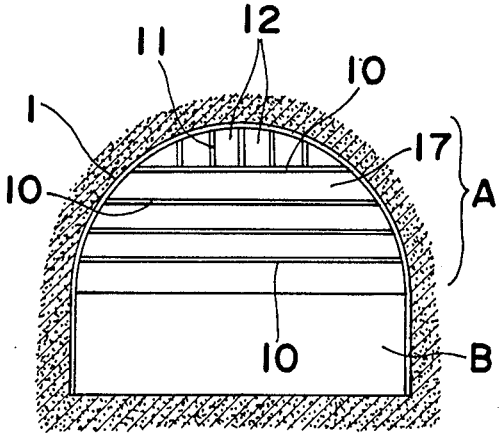
FIGS. 9 and 10 are views similar to FIGS. 5 and 6, respectively, particularly showing excavation of a large diameter tunnel by the tunnel excavation method of the present invention.
Figure 10:
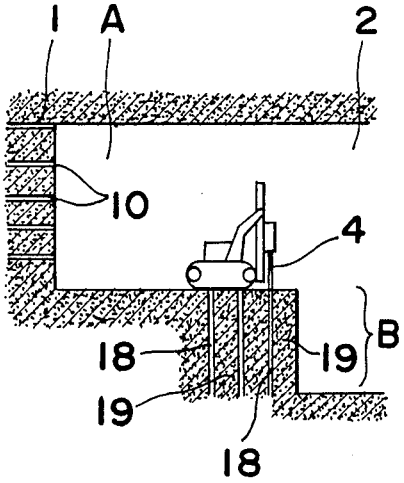

Hereinbelow, excavation of a large diameter tunnel 2 by the tunnel excavation method of the present invention will be described with reference to FIGS. 9 and 10. In this case, an upper half bedrock portion A of a cross section of the tunnel 2 is excavated by the above described tunnel excavation method of the present invention. Meanwhile, a lower half bedrock portion B of the cross section of the tunnel 2, whose upper face is exposed to the excavated upper half bedrock portion A, is divided into a plurality of bedrock blocks 19 in a direction of excavation of the tunnel 2 by a plurality of vertical slots 18 spaced a proper distance from each other. Then, the bedrock blocks 19 are sequentially cut off from the bedrock 3 by bench cut.

Figure 12:
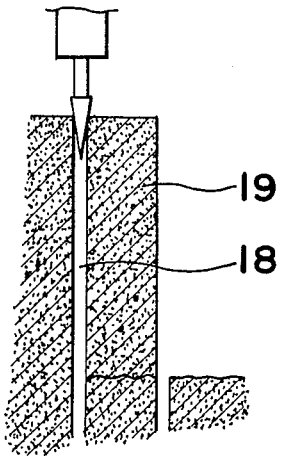
FIG. 12 is an enlarged fragmentary detailed view of FIG. 10, particulary showing bench cut.

At this time, the vertical slots 18 are bored in the lower half bedrock portion B up to a bottom portion of the tunnel 2 by using the slot boring machine 4. Meanwhile, in order to perform a bench cut, a wedge is driven into each of the vertical slots 18 as shown in FIG. 12 or a rock cracker is inserted into each of the vertical slots 18 so as to produce a crack at the bottom portion of each of the bedrock blocks 19 such that each of the bedrock blocks 19 is pushed down towards an entrance of the tunnel 2. In order to excavate the large diameter tunnel 2, this operation is performed alternately with excavation of the upper half bedrock portion A or is performed simultaneously with excavation of the upper half bedrock portion A after the upper half bedrock portion A has been excavated far deeper than the lower half bedrock portion B.

Meanwhile, in the above described embodiment of the present invention, the bedrock blocks 12 are formed at the uppermost one of the bedrock portions 17. However, it can be also so arranged that the bedrock blocks 12 are formed at an arbitrary one of the bedrock portions 17 and then, are removed from the bedrock 3 so as to define the working space 15 such that the remaining bedrock portions 17 are cut by the breaker 16 provided in the working space 15.

As is clear from the foregoing description, the tunnel excavation method of the present invention comprises the steps of boring the outer peripheral slot in the bedrock along the outer periphery of the cross section of the tunnel to be excavated, boring, at a proper vertical interval, a plurality of horizontal slots in the bedrock section surrounded by the outer peripheral slot such that the bedrock section is divided into a plurality of bedrock portions by the horizontal slots, boring a plurality of the vertical slots in an arbitrary one of the bedrock portions such that the arbitrary one of the bedrock portions is divided into a plurality of bedrock blocks by the vertical slots, removing the bedrock blocks from the bedrock so as to define the working space, and providing a proper excavator in the working space such that the remaining bedrock portions are excavated for removal sequentially in an increasing order of distance of the remaining bedrock portions from the arbitrary one of the bedrock portions by the excavator. The above described steps are repeated until the tunnel is excavated in the bedrock.

Accordingly, in accordance with the present invention, since the outer peripheral slot is preliminarily bored along the outer periphery of the tunnel to be excavated, the peripheral wall of the tunnel is finished accurately and smoothly and the bedrock does not loose due to stress concentration.

Furthermore, in accordance with the present invention, since the bedrock section surrounded by the outer peripheral slot is initially divided into a plurality of bedrock portions by the horizontal slots and then, only the arbitrary one of the bedrock portions is divided into a plurality of the bedrock blocks by the vertical slots such that the bedrock section is excavated, the bedrock blocks are separated from the remaining bedrock portions and the bedrock, thereby facilitating removal of the bedrock blocks from the bedrock.

Moreover, in accordance with the present invention, since the remaining bedrock portions are excavated by using a proper excavator through utilization of the working space obtained by removal of the bedrock blocks from the bedrock, the upper face of the upper one of the remaining bedrock portions is largely exposed to the working space and thus, the remaining bedrock portions can be efficiently ruptured for removal into large blocks due to tensile fracture from above.

Meanwhile, in the case where the large diameter tunnel is excavated by the tunnel excavation method of the present invention, the upper half bedrock portion of the tunnel is initially excavated by the above described tunnel excavation method of the present invention and then, the vertical slots spaced the proper distance from each other in the direction of excavation of the tunnel are bored in the lower half bedrock portion through utilization of the space of the excavated upper half bedrock portion such that the bedrock blocks of the lower half bedrock portion are sequentially cut off from the bedrock through the vertical slots.

Accordingly, in accordance with the present invention, since the lower half bedrock portion is crushed into large blocks, it becomes possible to excavate the tunnel efficiently by consuming a small amount of energy.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A method of excavating a tunnel in bedrock, comprising the steps of:

boring an outer peripheral slot in said bedrock along an outer periphery of a cross section of said tunnel boring in an upper half portion of said periphery a plurality of horizontal slots spaced vertically a first predetermined distance from each other such that said upper half of said periphery is divided into a plurality of bedrock portions by said horizontal slots;

boring a plurality of first vertical slots in one of said bedrock portions such that said one of said bedrock portions is divided into a plurality of first bedrock blocks by said first vertical slots;

removing said first bedrock blocks from said bedrock so as to define a working space;

providing an excavator in said working space such that remaining bedrock portions are excavated for removal sequentially so that said upper half portion of said periphery is excavated to a predetermined length so as to define an upper excavated space;

boring in a lower half portion of said periphery from said upper excavated space a plurality of second vertical slots extending substantially at right angles to the direction of excavation of said tunnel and spaced a second predetermined distance from each other in said direction of excavation of said tunnel such that said lower half portion of said periphery is divided into a plurality of second bedrock blocks by said second vertical slots; and removing said second bedrock blocks sequentially from said bedrock such that said lower half portion of said periphery is excavated to said predetermined length.

2. The method as claimed in claim 1, wherein said steps are repeated until said tunnel is excavated in said bedrock.

3. The method as claimed in claim 2, wherein said first bedrock blocks are removed from said bedrock by using an anchor bolt.

4. The method as claimed in claim 3, wherein said second bedrock blocks are removed from said bedrock by a bench cut.

5. The method as claimed in claim 1, wherein said bedrock blocks are removed from said bedrodk by using an anchor bolt.

6. A method of excavating a tunnel in bedrock, comprising the steps of:

boring an outer peripheral slot in said bedrock along an outer periphery of a cross section of said tunnel;

boring in an upper half portion of said periphery a plurality of horizontal slots spaced vertically a first predetermined distance from each other such that said upper half of said periphery is divided into a plurality of bedrock portions by said horizontal slots;

boring a plurality of first vertical slots in one of said bedrock portions such that said one of said bedrock portions is divided into a plurality of first bedrock blocks by said first vertical slots;

removing said first bedrock blocks from said bedrock so as to define a working space;

providing an excavator in said working space such that remaining bedrock portions are excavated for removal sequentially so that said upper half portion of said periphery is excavated to a predetermined length so as to define an upper excavated space;

boring in a lower half portion of said periphery from said upper excavated space a plurality of second vertical slots extending substantially at right angles to the direction of excavation of said tunnel and spaced a second predetermined distance from each other in said direction of excavation of said tunnel such that said lower half portion of said periphery is divided into a plurality of second bedrock blocks by said second vertical slots; and removing said second bedrock blocks sequentially from said bedrock such that said lower half portion of said peripheral slot is excavated to said predetermined length;

wherein, after said upper excavated space is formed, additional boring and excavation of said upper half portion occurs simultaneously with boring and excavation of said lower half portion.

7. The method as claimed in claim 6, wherein said steps are repeated until said tunnel is excavated in said bedrock.

8. The method as claimed in claim 7, wherein said second bedrock blocks are removed from said bedrock by a bench cut.

9. The method as claimed in claim 6, wherein said first bedrock blocks are removed from said bedrock by using an anchor bolt.

* * * * *